US011927425B2

(12) United States Patent
Padilla et al.

(10) Patent No.: US 11,927,425 B2
(45) Date of Patent: Mar. 12, 2024

(54) BOW CARRIER SYSTEM

(71) Applicants: Douglas Padilla, Albuquerque, NM (US); Ramon Armando Martinez, Albuquerque, NM (US)

(72) Inventors: Douglas Padilla, Albuquerque, NM (US); Ramon Armando Martinez, Albuquerque, NM (US)

( * ) Notice: Subject to any disclaimer, the term of this patent is extended or adjusted under 35 U.S.C. 154(b) by 92 days.

(21) Appl. No.: 17/475,117

(22) Filed: Sep. 14, 2021

(65) Prior Publication Data

US 2022/0082350 A1 Mar. 17, 2022

Related U.S. Application Data

(60) Provisional application No. 63/079,042, filed on Sep. 16, 2020.

(51) Int. Cl.

| | |
|---|---|
| ***F41C 23/02*** | (2006.01) |
| ***A45F 5/00*** | (2006.01) |
| ***F41B 5/14*** | (2006.01) |
| *F41B 5/10* | (2006.01) |

(52) U.S. Cl.

CPC ..... *F41B 5/1461* (2013.01); *A45F 5/00* (2013.01); *A45F 2005/006* (2013.01); *F41B 5/10* (2013.01)

(58) Field of Classification Search

CPC ..... Y10S 224/916; F41B 5/1461; F41B 5/10; F41C 23/02; A45F 2005/006; A45F 5/00; A45F 2200/0591; A45F 3/14; A45F 2003/142

USPC ..... 224/916, 269, 150

See application file for complete search history.

(56) References Cited

U.S. PATENT DOCUMENTS

| | | | | |
|---|---|---|---|---|
| 3,998,367 | A | 12/1976 | Harding | |
| 4,103,807 | A | 8/1978 | Lyon et al. | |
| 4,121,743 | A | 10/1978 | Burton | |
| 4,684,047 | A | 8/1987 | Burgwin | |
| 4,754,904 | A | 7/1988 | Fischer et al. | |
| 4,768,689 | A | 9/1988 | Davis | |
| 4,836,177 | A | 6/1989 | Williams | |
| 5,038,987 | A | 8/1991 | Huddleston | |
| 5,065,732 | A | 11/1991 | Smith | |
| 5,165,584 | A | 11/1992 | Meagher et al. | |
| 5,239,976 | A | 8/1993 | Specht | |
| 5,246,154 | A | 9/1993 | Adams et al. | |
| 5,370,286 | A | 12/1994 | Newman | |
| 5,499,752 | A | 3/1996 | Johnson | |
| 5,655,803 | A | 8/1997 | Tacoronte | |
| 5,697,537 | A | 12/1997 | Bowlsby | |
| 5,730,341 | A * | 3/1998 | Hester, Jr. | F41B 5/1461 224/916 |
| 5,806,508 | A | 9/1998 | Stempien et al. | |
| 5,816,461 | A | 10/1998 | Balcom | |
| 5,890,478 | A | 4/1999 | Dunmore | |
| 5,983,881 | A | 11/1999 | Killian | |
| 6,012,439 | A | 1/2000 | Woodruff | |

(Continued)

*Primary Examiner* — Adam J Waggenspack

(74) *Attorney, Agent, or Firm* — Kevin L. Soules; LOZA & LOZA, LLP

(57) ABSTRACT

A system, method, and apparatus for securely carrying a bow comprises: a body, a first end of the body further comprising a loop hook configured on the first end, a second end of the body, a bow mount configured on the second end of the body, and an external attachment point comprising: a strap, a loop in the strap configured to engage the loop hook; and a latch.

20 Claims, 11 Drawing Sheets

(56) References Cited

U.S. PATENT DOCUMENTS

| | | | | |
|---|---|---|---|---|
| 6,591,825 | B1 | 7/2003 | Huddleston | |
| 6,745,756 | B1 * | 6/2004 | Achkar | F41B 5/1461 124/88 |
| 6,932,254 | B2 | 8/2005 | Eliason | |
| 7,152,595 | B1 | 12/2006 | Muhich | |
| 7,347,196 | B1 * | 3/2008 | Shepley, Jr. | F41G 1/467 124/87 |
| 7,527,182 | B1 | 5/2009 | Sherwood et al. | |
| 7,770,768 | B1 | 8/2010 | Primos | |
| 7,798,137 | B2 | 9/2010 | Ewing | |
| 8,336,746 | B2 | 12/2012 | Leach | |
| 8,485,402 | B2 | 7/2013 | Smith | |
| 8,622,265 | B2 | 1/2014 | Arajakis | |
| 8,783,238 | B2 | 7/2014 | Julian | |
| 8,814,018 | B1 | 8/2014 | Mozes | |
| 8,931,466 | B2 | 1/2015 | Immesberger et al. | |
| 8,947,413 | B2 | 2/2015 | Hotelling et al. | |
| 9,146,073 | B1 | 9/2015 | Roy | |
| 9,310,158 | B2 | 4/2016 | Jones | |
| 9,689,641 | B2 | 6/2017 | Hamlin | |
| 9,915,499 | B2 | 3/2018 | Alford | |
| 2002/0162232 | A1 * | 11/2002 | Gomez-Vazquez | F41G 1/467 124/87 |
| 2010/0006615 | A1 | 1/2010 | Molyneaux | |
| 2010/0175675 | A1 | 7/2010 | Roberts et al. | |
| 2010/0206921 | A1 * | 8/2010 | Shen | F41C 33/002 224/150 |
| 2011/0204113 | A1 | 8/2011 | Reinarz et al. | |
| 2015/0219417 | A1 | 8/2015 | Billings et al. | |

* cited by examiner

BOW CARRIER SYSTEM

CROSS-REFERENCE TO RELATED PATENT APPLICATIONS

This patent application claims the priority and benefit under 35 U.S.C. § 119(e) of U.S. Provisional Patent Application Ser. No. 63/079,042, filed Sep. 16, 2020, entitled "A DEVICE THAT ATTACHES YOUR BOW TO A SLING AND CAN SILENTLY BE MANIPULATED WHILE HUNTING." U.S. Provisional Patent Application Ser. No. 63/079,042 is herein incorporated by reference in its entirety.

TECHNICAL FIELD

Embodiments are generally related to the field of archery. Embodiments are also related to systems, apparatuses, and methods for carrying bows and other equipment. Embodiments are further related to devices that attach a bow to a sling that can be manipulated silently while hunting. Embodiments are further related to connection devices configured to be affixed to a bow, which can be connected to external devices for convenient transportation of a bow.

BACKGROUND

Archery is an increasingly popular sport, both for target shooters and hunters. One major inconvenience is transporting a bow between uses, particularly in the field. The natural shape of a bow does not lend itself to being conveniently carried by hand. Furthermore, unlike firearms, bows include numerous delicate components that can be easily damaged if handled improperly. Finally, carrying a bow by hand is very inconvenient. It requires at least one hand at all times, and makes numerous relevant tasks impossible without setting the bow down.

Prior attempts at "bow slings" offer some advantages, but still fail to solve the problem. For example, a standard bow sling is loud, requires two attachment points, and does not allow the shooter to quickly remove the bow, which can be important in the field. Other devices are cumbersome and may take both hands to remove from the bow. Likewise, these tools may contact the string and cams of the bow which can potentially damage the bow. Other solutions provide attachment points that have to be placed in the archer's backpack or stored when not in use. They make it cumbersome to remove the bow and, in practical terms, cannot be actively used in the field.

As such, there is a need in the art for simple, cost effective, devices for carrying a bow in the field as disclosed herein.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide a method and system for carrying a bow and other equipment.

It is another aspect of the disclosed embodiments to provide a method and system/apparatus for connecting a bow to a backpack or other connection point for hands free transportation.

It is another aspect of the disclosed embodiments to provide a method and system or apparatus for an integrated device, connected to a bow, that can be connected to an external attachment point.

It is another aspect of the disclosed embodiments to provide methods, systems, and apparatuses for a device that connects a bow to a sling that can be manipulated silently while hunting.

The aforementioned aspects and other objectives and advantages can now be achieved as described herein. In an embodiment, the system further comprises a bend in the body angling the loop hook away from the plane of the body. In an embodiment, the system further comprises at least one cutout in the body. In an embodiment, the at least one cutout in the body is configured to comprise at least one of: a geometric shape, a letter, a word, a logo, and a design. In an embodiment, the at least one cutout in the body is configured to comprise a broadhead wrench.

In an embodiment, the system further comprises further comprises an external attachment point. In an embodiment, the mounting attachment comprises a loop hook. In an embodiment, the external attachment point further comprises a strap, a loop in the strap configured to engage the loop hook, and a latch.

In an embodiment, the bow mount further comprises at least two slits, the at least two slits being spaced to match a standardized mounting hole pattern on a bow. In an embodiment, the bow mount further comprises at least two fingers and a set of mounting holes, one on each of the at least two fingers, wherein the set of mounting holes are spaced to match a standardized mounting hole pattern on a bow.

In an embodiment, the body is configured from at least one of: cold rolled steel, stainless steel, titanium, carbon fiber, hard plastic, and hard rubber.

BRIEF DESCRIPTION OF THE FIGURES

The accompanying figures, in which like reference numerals refer to identical or functionally-similar elements throughout the separate views and which are incorporated in, and form a part of the specification, further illustrate the embodiments and, together with the detailed description, serve to explain the embodiments disclosed herein.

DETAILED DESCRIPTION

Figure 1A:
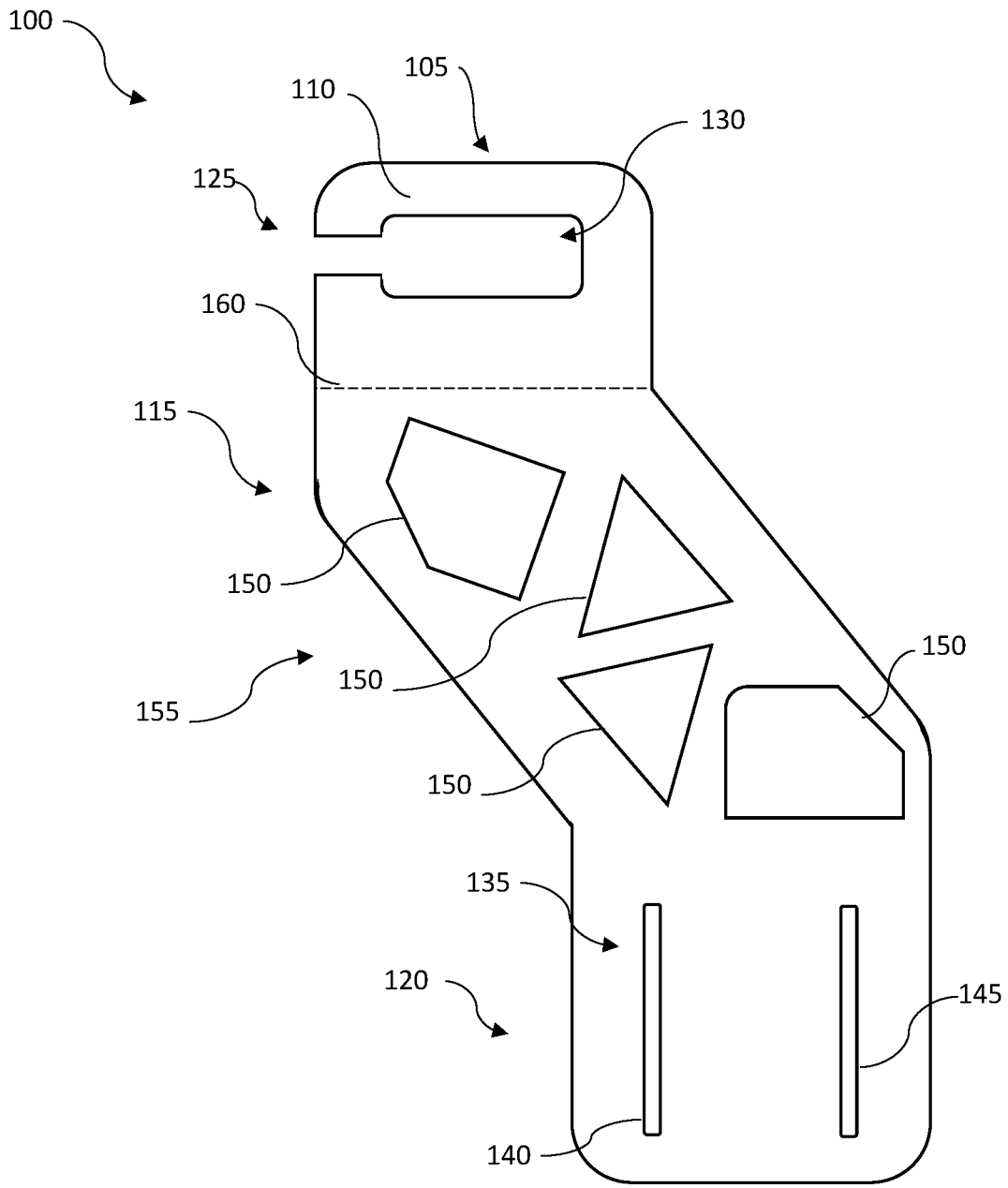
FIG. 1A depicts a bow connector, in accordance with the disclosed embodiments.

The particular values and configurations discussed in the following non-limiting examples can be varied, and are cited merely to illustrate one or more embodiments and are not intended to limit the scope thereof.

Example embodiments will now be described more fully hereinafter with reference to the accompanying drawings, in which illustrative embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context. All aspects of the various embodiments can be interchangeable with aspects disclosed in other embodiments, and/or can be incorporated in other embodiments.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

Figure 1B:
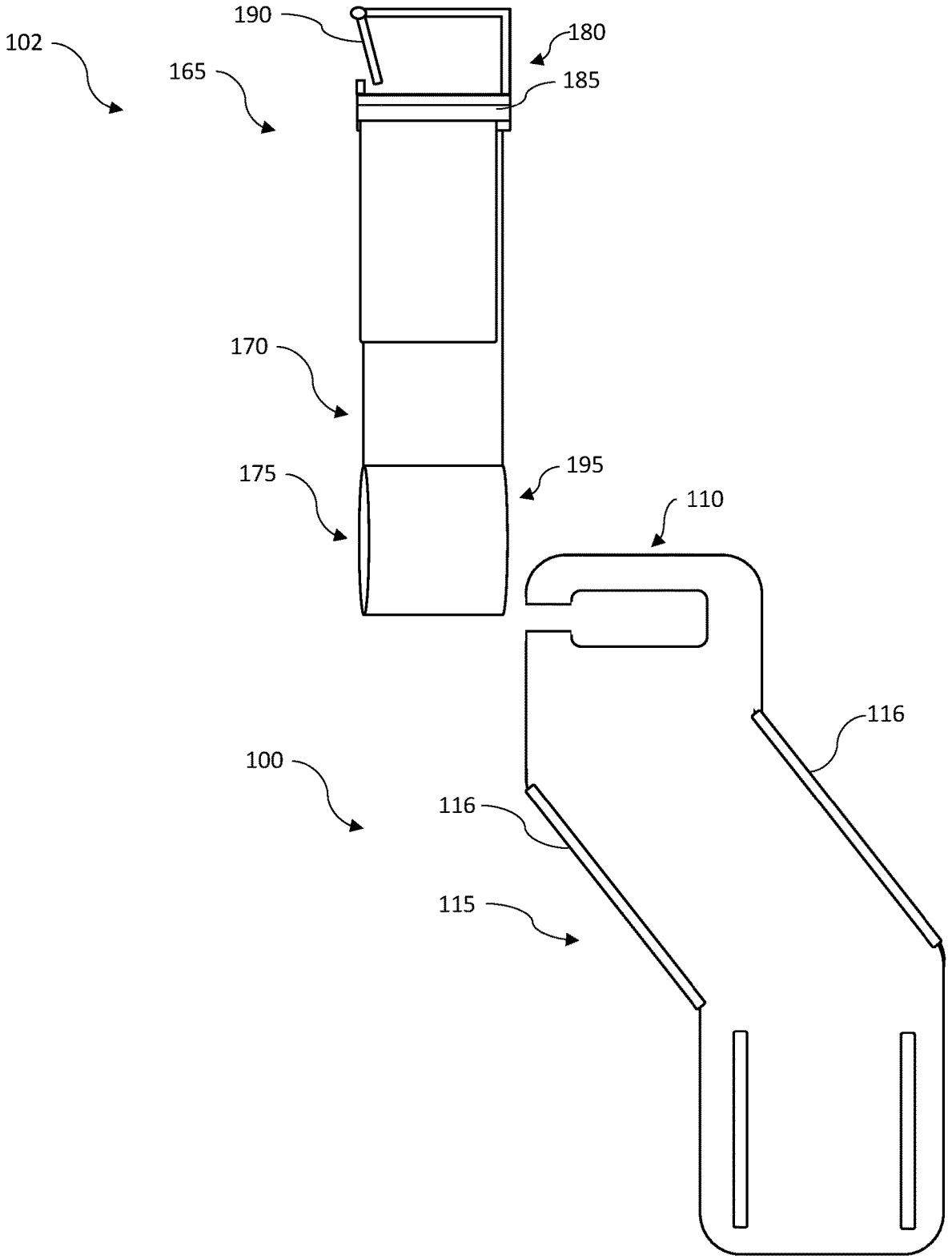
FIG. 1B depicts a bow connector system, in accordance with the disclosed embodiments.

In certain embodiments, a bow connector 100, as illustrated in FIG. 1A and FIG. 1B, is presented, in accordance with the disclosed embodiments. The bow connector 100 is generally configured to be mounted to a bow on one end 120. The bow connector 100 further includes a loop hook 110 configured to be connected to an external connection point.

The bow connector 100 can generally comprise a body 115. The body can generally be formed of a flat or substantially flat sheet of material. The body 115 can be configured of metal, including but not limited to cold rolled steel, stainless steel, titanium, aluminum, copper, metal alloys, or the like. These materials are selected for their high strength to weight ratio. In other embodiments, the body 115 can be made of carbon fiber, hard plastic, hard rubber, wood, or other such durable material. In certain embodiments, the body 115, can include a rubber coating 116 around some or all the perimeter edges of the body 115. In certain embodiments, the size of the body 115 can be selected to match various bows, sights, quivers, etc. For example, in certain embodiments, the body can come in a small, medium, or large size.

In an exemplary embodiment, the bow connector 100 body 115 can comprise a substantially parallel first end 105, and second end 120, with a slanting middle portion 155 connecting the first end 105 and second end 120. The bow connector 100 is designed to connect to a bow along the flat, or substantially flat surface of the second end 120. The width of the body 115 lends structural strength to the bow connector 100.

In other embodiments, the body 115 can be rounded, straight, or angled. In exemplary embodiments, the shape can be selected to move the center of gravity, or balance point of the body 115, to be at or near the D-loop on the bow string. This point of balance may change with various bow configurations, and the body 115 can be shaped accordingly.

In certain embodiments, the body 115 can be machined using a CNC machine or waterjet to cut the body 115 from a single piece of rigid, light weight, and durable material utilizing a CAD drawing. Next first end 105 and/or second end 120 can be bent out of the plane of body 115. In certain embodiments, the bend can be approximately a 30-degree angle, but other angles can be selected as necessary for the specific design of the bow. Once the body is bent it can be sanded and painted.

In other embodiments the body 115 can be fabricated using a punch/press template utilizing a CAD drawing and repeatedly punching out the shape from a single piece of rigid, light weight, and durable metal. Next body 115, can be bent, as disclosed above, to approximately a 30-degree angle. Once the body is bent it can be sanded and painted.

In certain embodiments, the body 115 of the bow connector can be painted various colors, including but not limited to, black, and camouflage. In other embodiments, the body can be powder coated, cerakoted, UV printed, hydro dipped, and/or laser etched or engraved.

The body 115 includes first end 105 and second end 120, which can be connected at an angle with a center portion 155. The first end 105 can be configured with a mounting attachment 125. It should be appreciated that the mounting attachment 125 can comprise, a loop, a buckle, a carabiner, a latch, or other such connector. In FIG. 1A, the mounting attachment comprises a loop hook 110 creating an opening 130 that can be engaged through a loop on an attachment point such as a loop on a backpack, a wall hook, a strap with a loop, a tree branch, or other such connection point. It should be appreciated that in other embodiments the mounting attachment 125 can be configured as another type of connector, including a male/female buckle, a cam buckle, side release buckles, snap buckles, brass buckles, military metal buckles, plastic buckles, or the like.

The second end 120 of the body 115 is configured with a bow mount 135. The bow mount 135 can comprise a first slit 140 and second slit 145. The slits 140 and 145 can be selected to match the pattern of bow sight mounting holes on a bow, configured for mounting a bow sight, and/or quiver. The slits 140 and 145 allow the body location to be adjusted with respect to a quiver mounted on the bow, such that the mounting attachment 125 extends beyond the quiver. It is important to note, in certain embodiments, the body 115 can be mounted directly to a bow. For example, some bows do not use sights, including traditional bows, long bows, recurve bows, as well as some compound bows. It should further be appreciated that, in certain embodiments, the body 115 can be flipped longitudinally to be utilized in front of the bow riser near the sight instead of by the bow string if it is more comfortable for the archer. Likewise, the body 115 can be flipped transversally so that the mounting attachment opens toward either the top of the bow or bottom of the bow.

The body 115 can further comprise one or more cutouts 150 configured in the center portion 155 of the body, or along other areas of the body 115. The cutouts 150 can be configured to reduce the total weight of the body 115. The cutouts 150 in the body can be configured to comprise a geometric shape, a letter, a word, a logo, a design or some combination thereof. In other embodiments, the cutouts 150 can comprise a broadhead wrench 250 configured to aid in installing or removing a broad head to the end of an arrow shaft.

In certain embodiments, the first end 105 can bent out of the plane of the body 115 along exemplary dashed line 160. The bend allows the loop hook 110 to conveniently angle away from the bow to ease the task of connecting the bow connector 100 to an external connection point. In other embodiments, the body 115 can be bent according to the shape and size of the bow where the body 115 will be mounted. For example, one popular compound bow model may require two bends in the body 115 to accommodate, and not interfere with the roller/cable slide of the bow. These bends can be incorporated as needed for a specific bow shape and size. Likewise, in certain embodiments, the body 115 can be configured without a bend away from the plane of the body 115.

FIG. 1B illustrates additional aspects of a bow connector system 102, in accordance with the disclosed embodiments. FIG. 1B shows an external attachment point 165 associated with the bow connector. The external attachment point 165 can generally comprise a strap 170 with a loop 175 formed on a first end 195. The loop 175 is configured to slip into the loop hook 110, allowing the body 115 to connect to the external attachment point 165.

The external attachment point 165 can further comprise a latch 180. The latch 180 is configured with a strap adjuster 185 The strap 170 can be looped through the strap adjuster so that the terminal length of the first end 195 can be adjusted to a desired length. The latch 180 further includes a latching gate 190 configured to allow the latch 180 to be connected to, for example, a loop on a backpack, a belt loop, a binocular harness, a shoulder sling, an external hook, or other such connection point. The latching gate 190 can be configured to be spring loaded such that the latching gate 190 is biased toward a closed position.

In practice, the external attachment point 165 can be secured to an archer on their backpack, clothing, storage point, or other such point. Once the body 115 is mounted to the archer's bow, the archer can slip the loop 175 into the loop hook 110. The bow connector thus allows the bow to hang on the person of the archer, hands free. When the archer is ready to use the bow, they can simply slip the loop 175 off of the loop hook 110, and the bow is ready for use.

Figure 2:
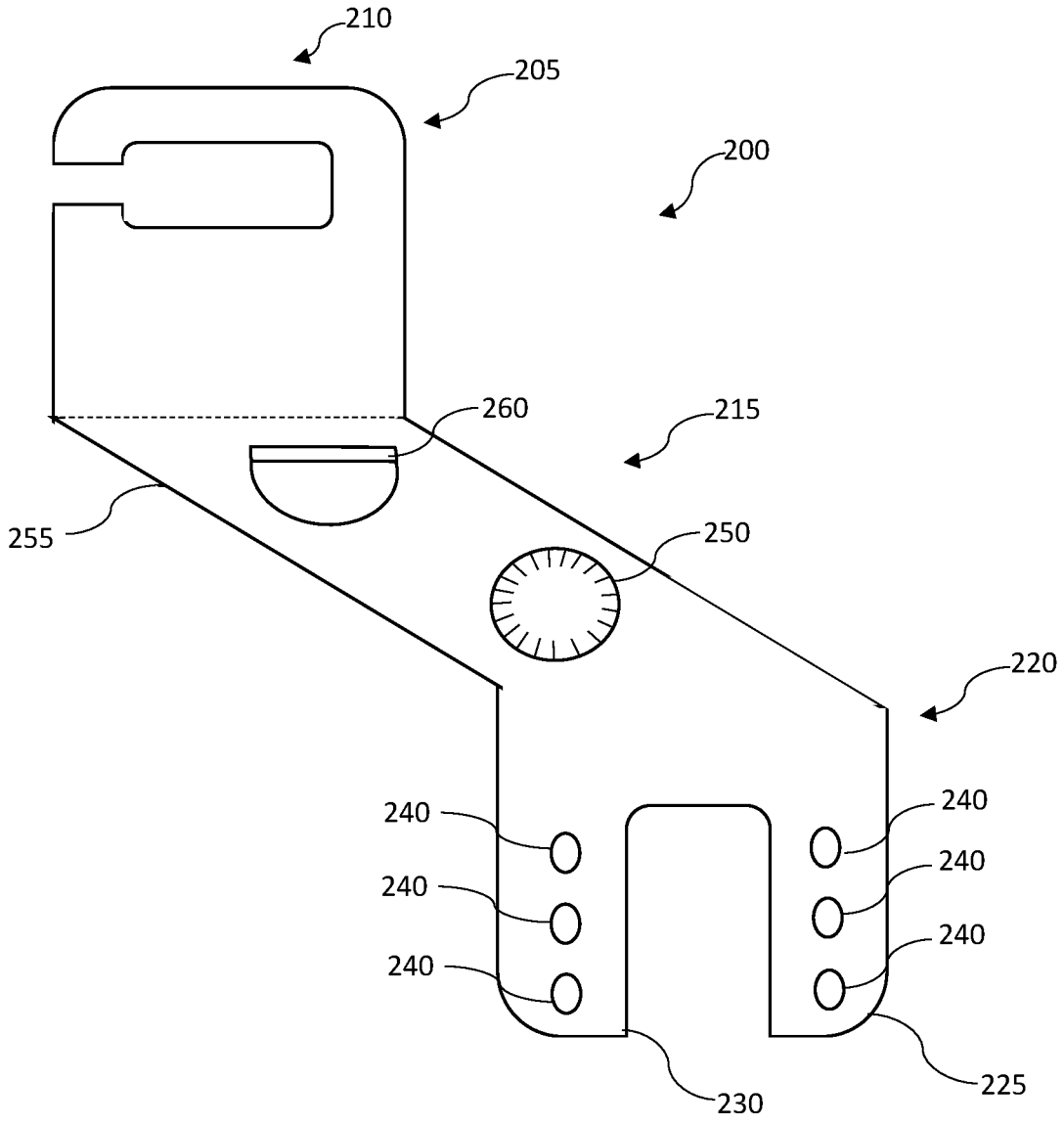
FIG. 2 depicts another embodiment of a bow connector, in accordance with the disclosed embodiments.

FIG. 2 illustrates another embodiment of a bow connector 200, in accordance with the disclosed embodiments. The bow connector 200 generally includes a body 215 with a loop hook 210 configured on one end 205. In the embodiment illustrated in FIG. 2, the body 215 is necked down to reduce the weight of the bow connector 200. A bottle opener 260 can be configured on the body 215.

In addition, the second end 220 of the body 215 is configured with a first finger 225 and a second finger 230. Each of the fingers 225 and 230 is configured with one or more sets of mounting holes 240. It should be noted that in FIG. 2 three sets of mounting holes 240 are illustrated, but in other embodiments, more or fewer sets of mounting holes can be used. The sets of mounting holes 240 can be configured to match the standardized hole pattern on a bow, with holes and hardware for mounting a bow sight. Likewise, in certain embodiments, the sets of mounting holes 240 can be configured to match the standardized hole pattern on a bow sight or mountable bow quiver. In practice, this means the bow connector 200 can be mounted directly on the bow, on the bow sight, on the quiver, or sandwiched between the bow sight and quiver mount. Installation is as simple as removing the mounting screws, placing the hole pattern of mounting holes 240 over the desired position on the bow/bow sight/quiver, and replacing the mounting screws.

While most archers will prefer the bow connector 200 to be mounted to the bow such that the loop hook 210 extends behind the bow riser (nearer to the bow string), the standardized mounting pattern allows the bow connector 200 to be mounted in the opposite direction if desired. Likewise, the orientation of the loop hook 210 can be selected to be upward pointing or downward pointing, simply by flipping the bow connector 200 over before installation.

Figure 3A:
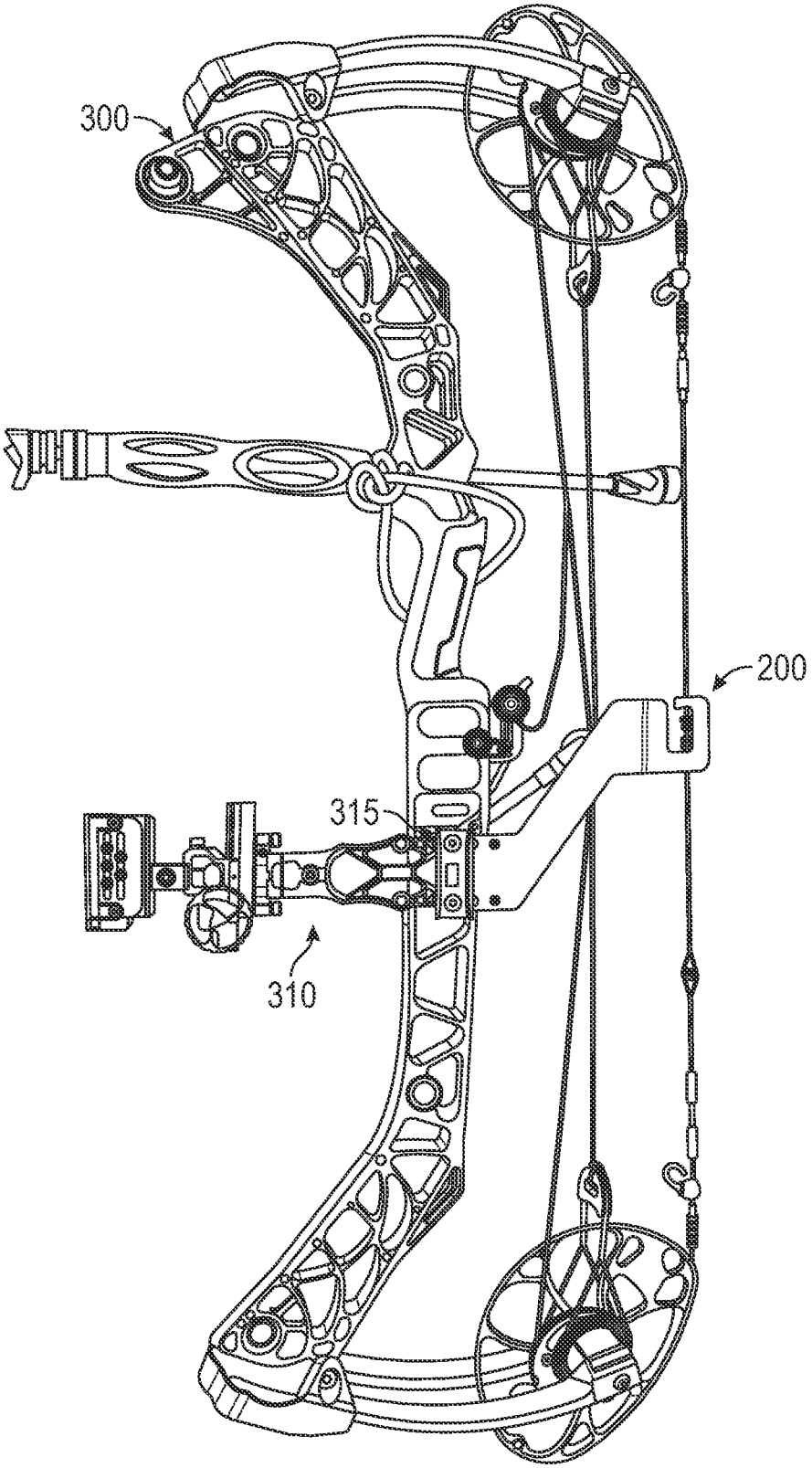
FIG. 3A depicts a bow connector connected to a bow, in accordance with the disclosed embodiments.
Figure 3B:
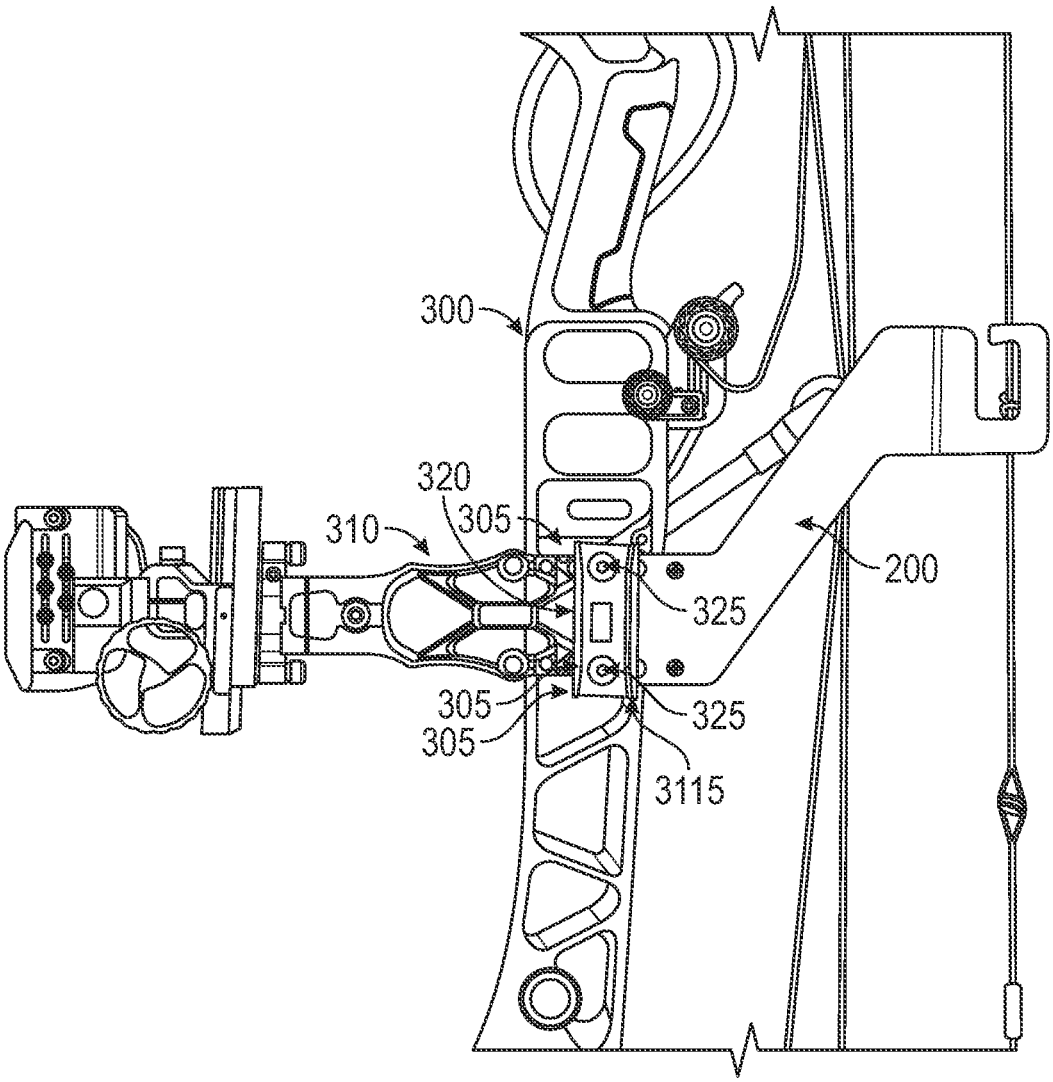
FIG. 3B depicts an exploded view of a bow connector connected to a bow, in accordance with the disclosed embodiments.

FIGS. 3A and 3B illustrate the bow connector 200 connected to a bow 300 in accordance with the disclosed embodiments. As illustrated a bow connector such as bow connector 200 can be configured to attach to a bow 300. The bow 300 can come configured with a set of standardized mounting holes 305. The mounting holes are configured for mounting a bow sight 310 and/or a quiver mount 315 as illustrated.

In certain embodiments, the bow connector 200 can be arranged with a set of mounting holes 240 aligned with the mounting holes 320 on a bow sight 310 and/or the standardized mounting holes 305 on the bow. In certain embodiments, a quiver or quiver mount 315 can also be aligned with the mounting holes on the bow sight, and the mounting holes 240 on the bow connector 200.

Once all the holes are aligned, mounting screws 325 and 330 can be inserted through the mounting holes 240, as well as the mounting holes on the quiver mount 315, and the bow sight 310, and threaded into the standardized mounting holes 305. In this way, the bow connector 200 can be mounted to the bow 300.

Figure 4:
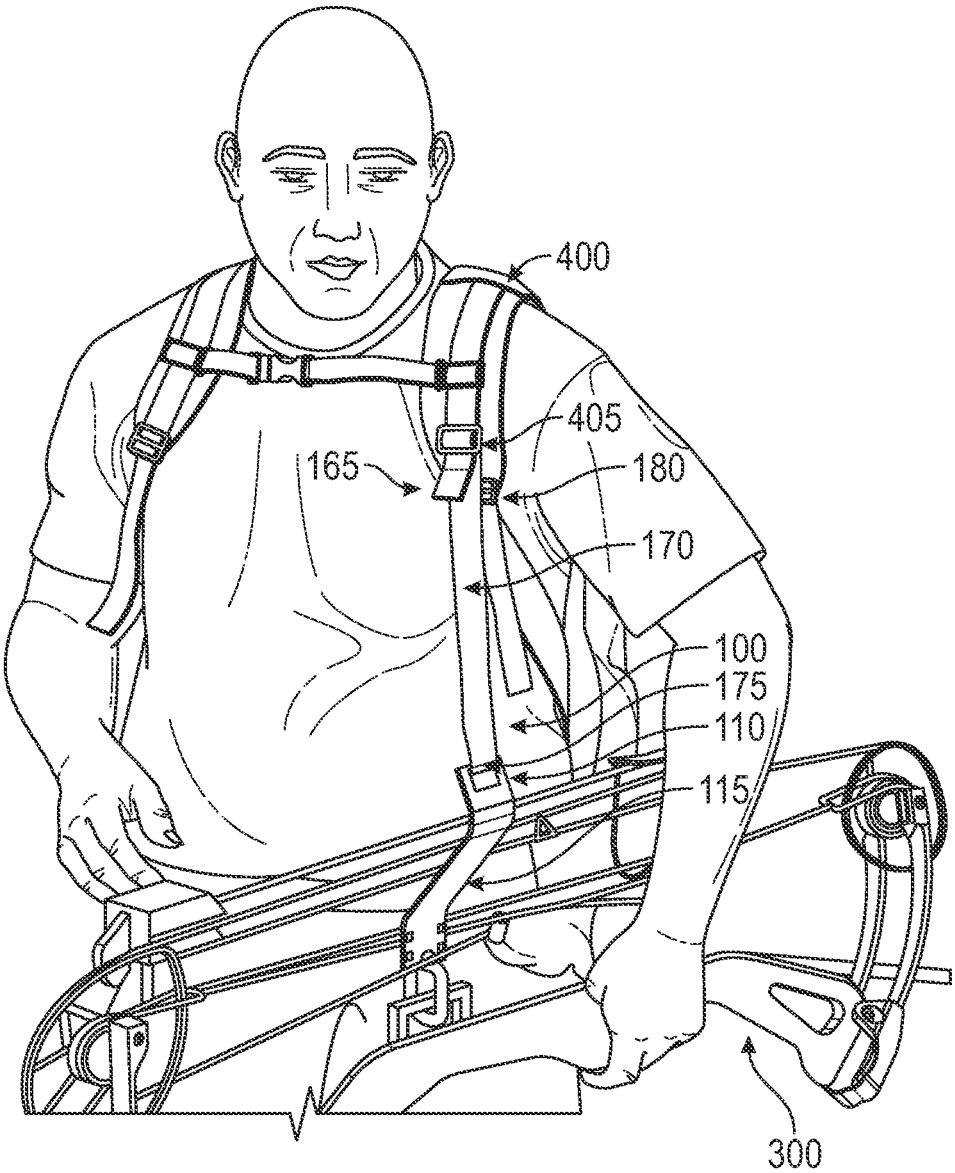
FIG. 4 depicts a bow connector system connected to a bow and an archer, in accordance with the disclosed embodiments.

FIG. 4 illustrates the bow connector system 102 mounted to a backpack 400, in accordance with the disclosed embodiments. As illustrated, the bow connector system 102 can include the external attachment point 165 associated with the bow connector system 102. The external attachment point 165 can include the strap 170 with a loop 175 formed on a first end 195. The loop 175 is configured to slip into the loop hook 110, allowing the body 115 to connect to the external attachment point 165.

The latch 180 can be connected to, for example, a backpack strap 405. In practice, the external attachment point 165 can be connected to the load lifting strap 405 of a backpack. The loop 175 can fit into the loop hook 110. The bow connector system 102 thus allows the bow to hang on the person of the archer.

Figure 5A:
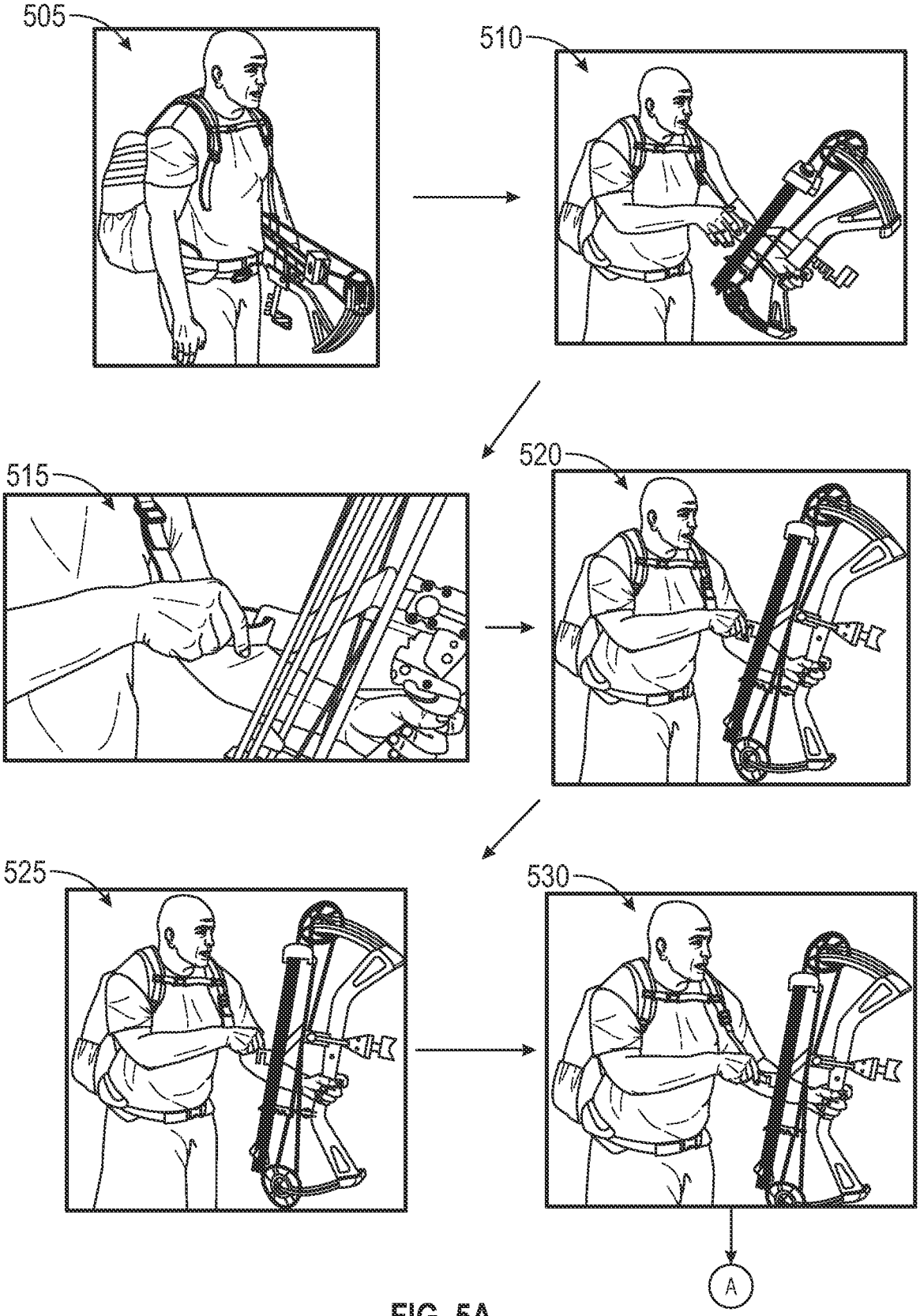
FIGS. 5A and 5B depict a method for carrying a bow with a bow connector system connected to the bow, in accordance with the disclosed embodiments.
Figure 5B:
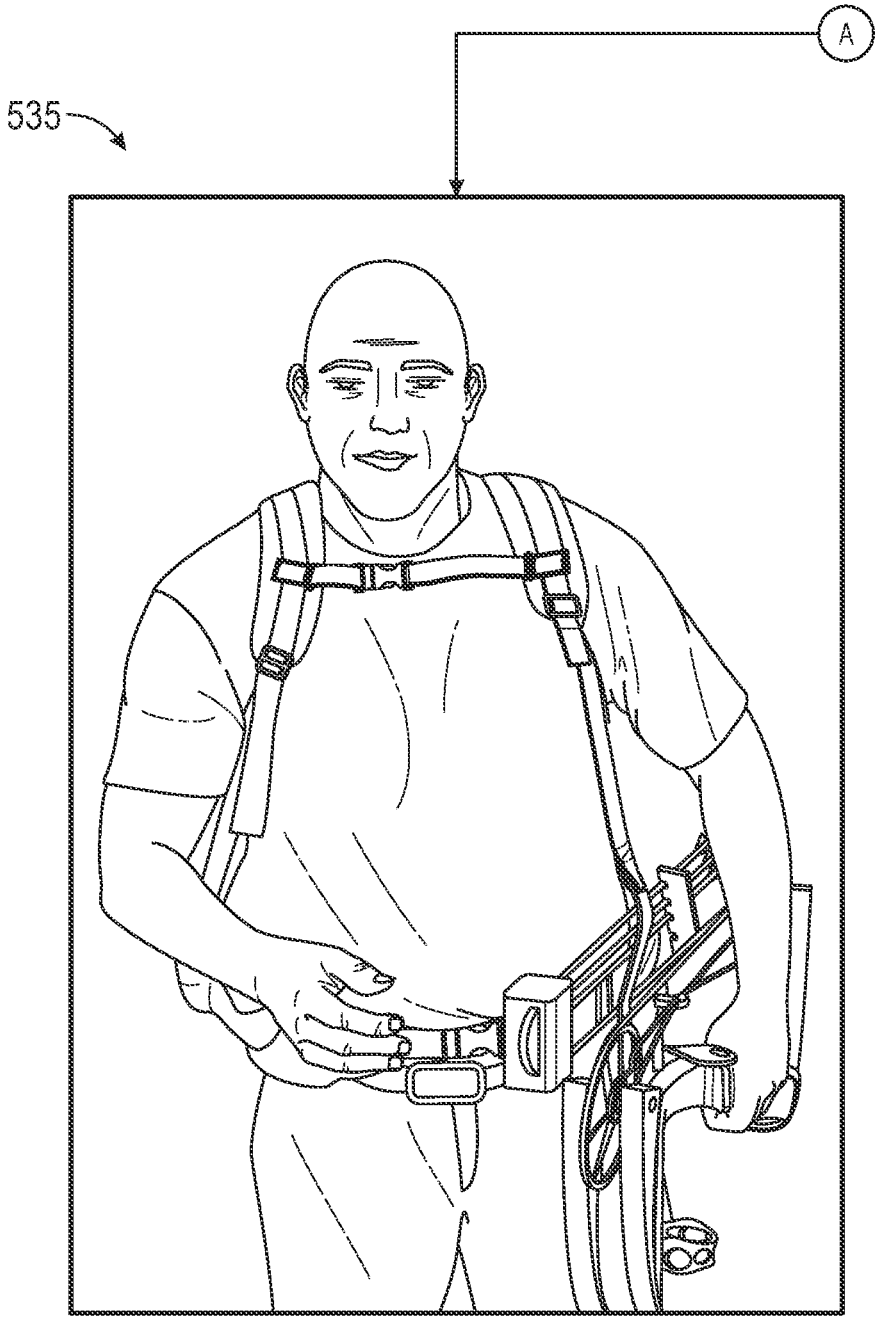

FIG. 5 illustrates steps associated with the use of the bow connector system 200, including connecting and disconnecting a bow connector, such as bow connector 100 or bow connector 200 in accordance with the disclosed embodiments. As illustrated at 505, the bow connector system 102 can be used to connect the bow to a backpack. When the archer is ready to use the bow, the archer can grab the bow as shown at step 510. At step 515, the archer can slip the strap loop off the loop hook. Once the strap loop is disconnected, the bow has been disconnected from the body of the bow connector, as shown at 520. The bow is now ready to be drawn as shown at 525. Once the archer is ready to reconnect the bow, the strap loop can be reattached to the loop hook as shown at 530. The bow can once again be securely connected to the archer for transportation, as illustrated at step 535.

Figure 6:
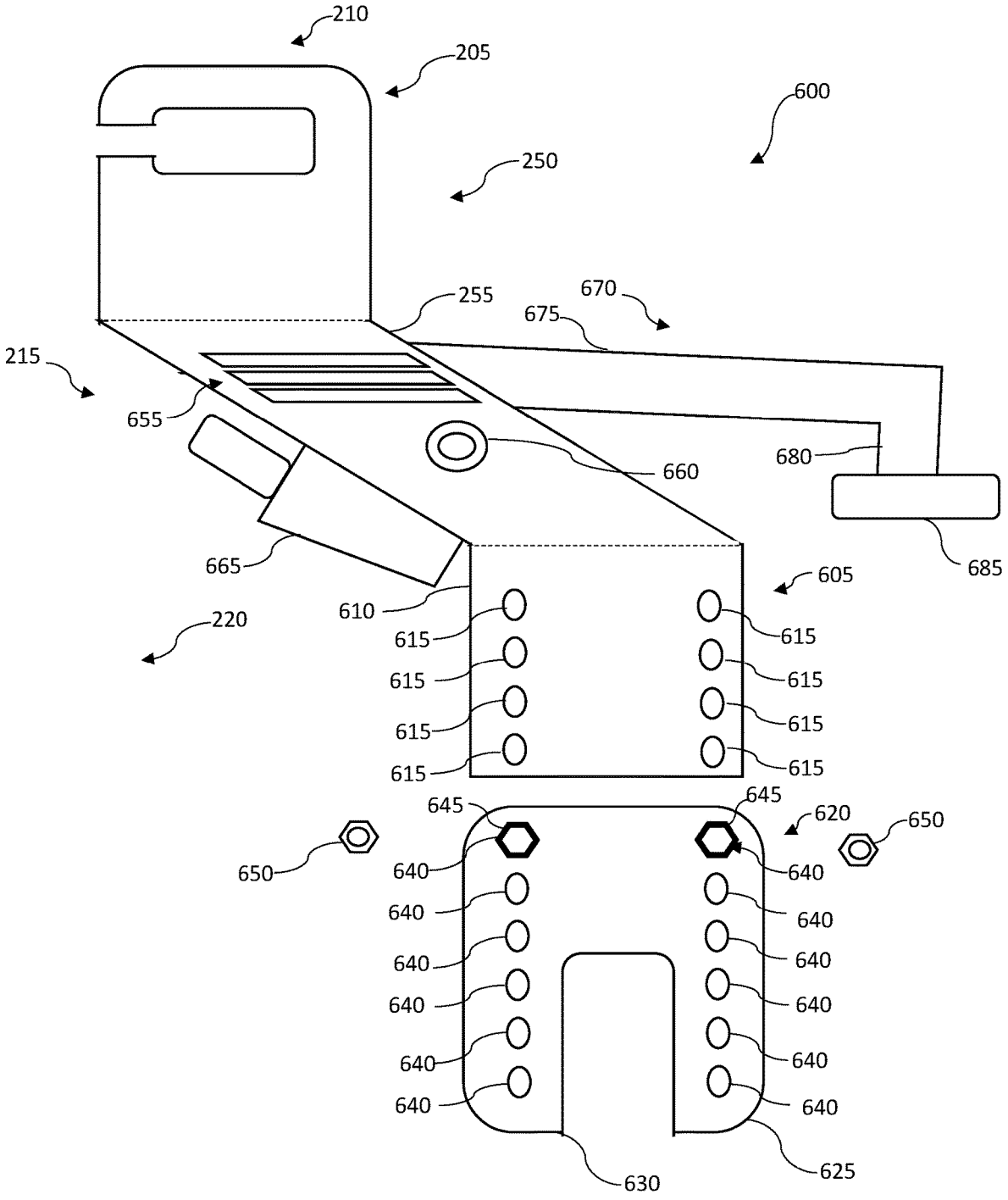
FIG. 6 depicts an embodiment of a bow connector, in accordance with the disclosed embodiments.

FIG. 6 illustrates another embodiment of an adjustable length system 600, in accordance with the disclosed embodiments. Some or all of the features illustrated in FIG. 6 can be incorporated in other embodiments disclosed herein. As illustrated in FIG. 6, the body 215 can include loop hook 210 configured on one end 205, and center body 255 forming an angled connection to a second end 605. The second end 605 can comprise a length adjustment tab 610. The length adjustment tab 610 can include one or more sets of adjustment holes 615.

The adjustable length system 600 can further include a bow mount tab 620 configured with a first finger 625 and a second finger 630. Each of the fingers 625 and 630 is configured with one or more sets of mounting holes 640. It should be noted that in FIG. 6 six sets of mounting holes 640 are illustrated, but in other embodiments, more or fewer sets of mounting holes 640 can be used. The sets of mounting holes 640 can be configured to match the standardized hole pattern on a bow, with holes and hardware for mounting a bow sight, and can match the pattern of adjustment holes 615. Likewise, in certain embodiments, the sets of mounting holes 640 can be configured to match the standardized hole pattern on a bow sight or mountable bow quiver.

The adjustable length system 600 can be mounted directly on the bow, on the bow sight, on the quiver, or sandwiched between the bow sight and quiver mount via mounting holes 640. Installation is as simple as removing the mounting screws, placing the hole pattern of mounting holes 640 over the desired position on the bow/bow sight/quiver, and replacing the mounting screws. Mounting bolts 645 can then be inserted through the overlayed mounting holes 640 and adjustment holes 615 such that the system 600 has the desired length. The mounting bolts 645 can be secured with mounting nuts 650.

The body 215, can include diaphragm slots 655 configured to store diaphragm calls. The diaphragm slots 655 can be configured as slots in the body 215, or flaps affixed to the external surface of the body 215. FIG. 6 illustrates 3 such diaphragm slots 655 but other numbers of diaphragm slots can be used in other embodiments.

The body 215 can further be configured to be magnetic, and/or include integrated magnet 660. The magnet 660 can be configured to hold a bow string release on the body 215. In other embodiments, the magnet 660 can be used to hold other magnetized objects to the body, including but not limited to, a mobile phone, a light, a knife, a tool including but not limited to a bow tuning tool, or the like. The body 615 can further include an integrated knife sheath 665 configured to store and carry a knife, tool, or other such device.

In certain embodiments, the body can further include a camera mount 670. The camera mount 670 can comprise a riser 675 affixed to a camera standoff 680. The camera standoff 680 can face generally toward the front of the bow. The camera standoff 680 can be affixed to a camera holding fixture 685, which can be configured to hold a camera, cell phone, video camera, or other such recording device. The camera mount 670 can allow an archer to record the scene in front of the bow, for example, to capture, shots as they are taken.

Figure 7:
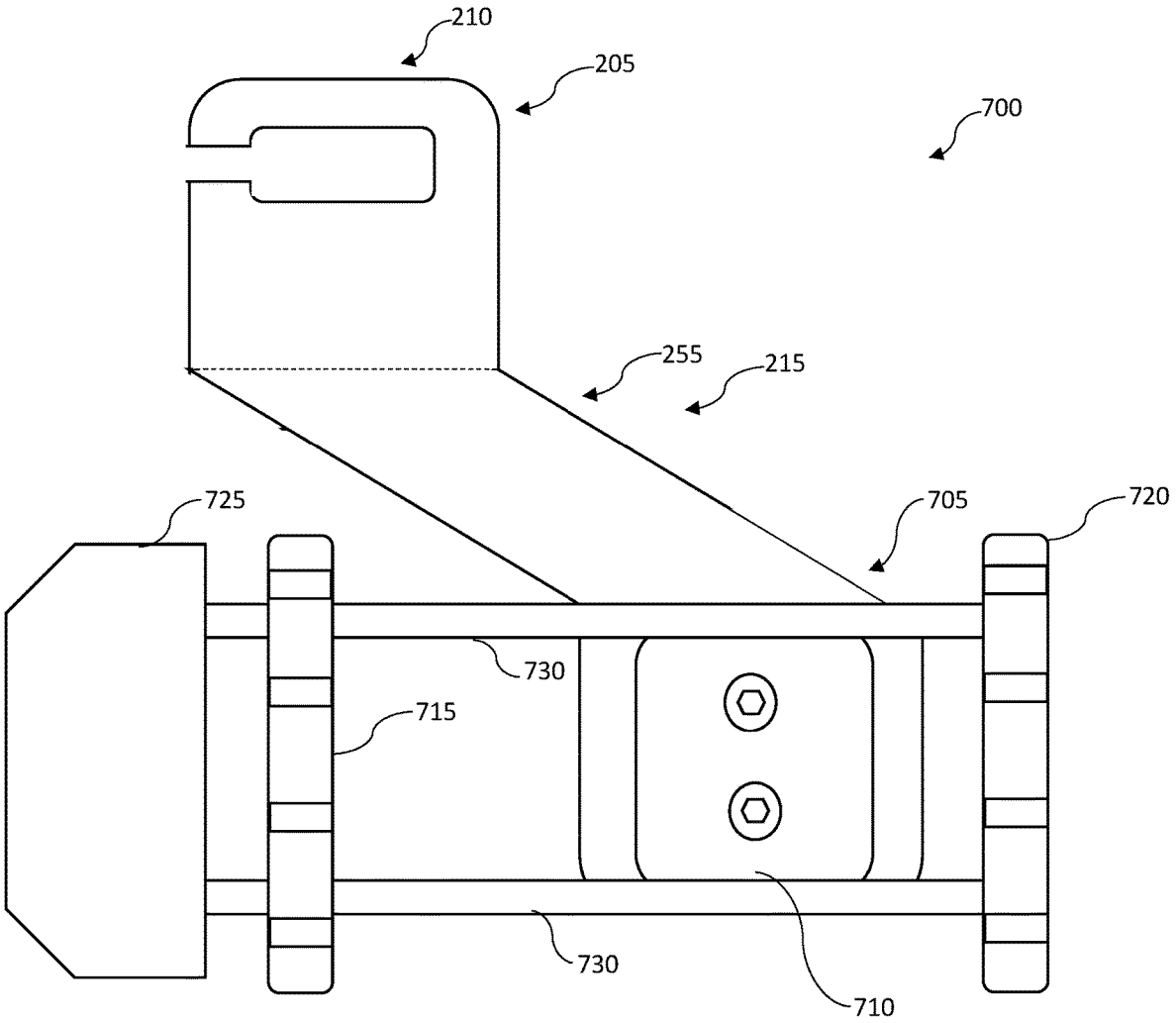
FIG. 7 depicts a bow connector integrated with a quiver, in accordance with the disclosed embodiments.

FIG. 7 illustrates another embodiment, comprising an integrated quiver attachment system 700 in accordance with the disclosed embodiments. In such an embodiment, the body 215 can be incorporated into a quiver 700. As illustrated in FIG. 7, the body 215 can include loop hook 210 configured on one end 205, and center body 255 forming an angled connection to a second end 705. The second end 705 can comprise a quiver mount plate 710. The quiver mount plate 710 can comprise the attachment point between the integrated quiver attachment system 700 and a bow. The integrated quiver attachment system 700 can further comprise an upper arrow grip 715, lower arrow grip 720, and arrow hood 725. The upper arrow grip 715, lower arrow grip 720, and arrow hood 725, can be connected via one or more support struts 730.

Figure 8:
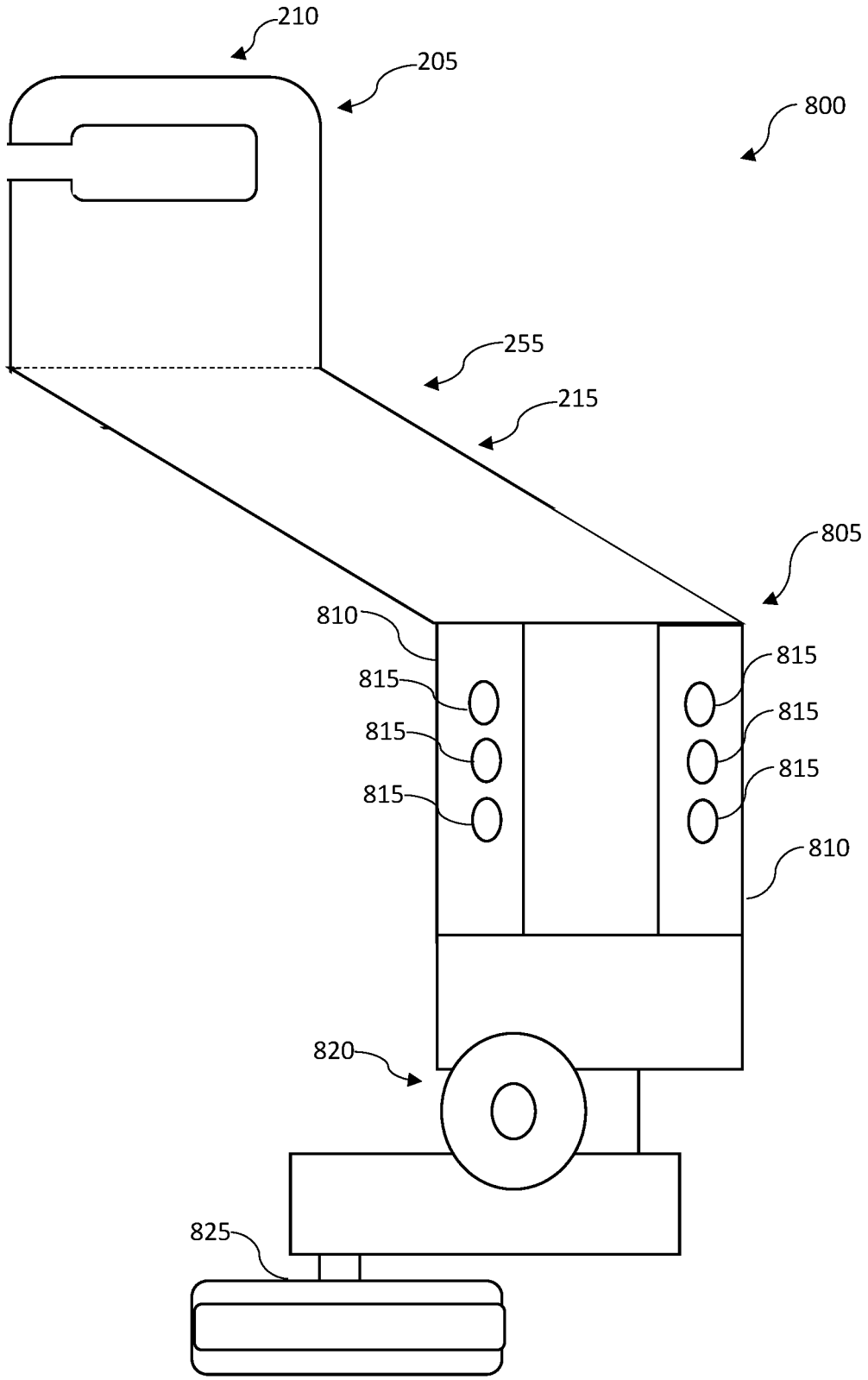
FIG. 8 depicts a bow connector integrated with a bow sight, in accordance with the disclosed embodiments.

FIG. 8 illustrates another embodiment, comprising an integrated bow sight attachment system 800 in accordance with the disclosed embodiments. In such an embodiment, the body 215 can be incorporated into an integrated bow sight attachment system 800. As illustrated in FIG. 8, the body 215 can include loop hook 210 configured on one end 205, and center body 255 forming an angled connection to a second end 805. The second end 805 can comprise one or more bow sight mounting arms 810. The bow sight mounting arms 810 can include one or more sets of mounting holes 815. The bow sight mounting arms 810 can be further connected to a bow sight housing 820, configured to hold a sight pin assembly 825.

Based on the foregoing, it can be appreciated that a number of embodiments, preferred and alternative, are disclosed herein. The disclosed embodiments comprise a single piece of durable, light weight, rigid metal that is attached to a bow sight utilizing two screws. Once the invention is attached to the bow it will never have to be removed and will always be ready to function.

For example, a system comprises a body; a first end of the body further comprising a mounting attachment configured on the first end; a second end of the body; and a bow mount configured on the second end of the body, wherein the body connects the first end of the body and the second end of the body.

In an embodiment, the system further comprises a bend in the body angling the loop hook away from the plane of the body. In an embodiment, the system further comprises at least one cutout in the body. In an embodiment, the at least one cutout in the body is configured to comprise at least one of: a geometric shape, a letter, a word, a logo, and a design. In an embodiment, the at least one cutout in the body is configured to comprise a broadhead wrench.

In an embodiment, the system further comprises further comprises an external attachment point. In an embodiment, the mounting attachment comprises a loop hook. In an embodiment, the external attachment point further comprises a strap, a loop in the strap configured to engage the loop hook, and a latch.

In an embodiment, the bow mount further comprises at least two slits, the at least two slits being spaced to match a standardized mounting hole pattern on a bow. In an embodiment, the bow mount further comprises at least two fingers and a set of mounting holes, one on each of the at least two fingers, wherein the set of mounting holes are spaced to match a standardized mounting hole pattern on a bow.

In an embodiment, the body is configured from at least one of: cold rolled steel, stainless steel, titanium, carbon fiber, hard plastic, and hard rubber.

In an embodiment, a bow connector system comprises a body, a first end of the body further comprising a loop hook configured on the first end, a second end of the body, a bow mount configured on the second end of the body, and an external attachment point comprising: a strap, a loop in the strap configured to engage the loop hook, and a latch.

In an embodiment, the bow connector system further comprises a bend in the body angling the loop hook away from the plane of the body.

In an embodiment of the bow connector system the bow mount further comprises at least two slits, the at least two slits being spaced to match a standardized mounting hole pattern on a bow. In an embodiment of the bow connector system the bow mount further comprises: at least two fingers and a set of mounting holes, one on each of the at least two fingers, wherein the set of mounting holes are spaced to match a standardized mounting hole pattern on a bow.

In an embodiment, a system comprises a body, a first end of the body further comprising a mounting attachment configured on the first end, a second end of the body with a bow mount configured on the second end of the body, wherein the bow mount further comprises: at least two fingers and a set of mounting holes, one on each of the at least two fingers.

In an embodiment, the system further comprises a bend in the body angling the first end away from the plane of the body. In an embodiment, the system further comprises a bend in the body angling the second end away from the plane of the body.

In an embodiment, the system further comprises at least one cutout in the body, the at least one cutout in the body configured to comprise at least one of: a geometric shape, a letter, a word, a logo, a design, a broadhead wrench, and a bottle opener.

In an embodiment, the system further comprises an external attachment point, the external attachment point further comprising: a strap, a loop in the strap configured to engage the loop hook, and a latch.

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A system comprising:

a body comprising:

a first end;

a second end; and a center portion wherein the first end and second end are substantially parallel, and the center portion is at an angle connecting the first end and second end;

a loop hook formed on the first end of the body wherein the loop hook is configured to hook onto a loop; and a bow mount configured on the second end of the body, the bow mount further comprising: a first finger, a second finger, and at least one mounting hole set wherein the at least one mounting hole set is spaced to match a standard hole pattern for a bow sight.

2. The system of claim 1 further comprising:

a bend between the first end and center portion such that the loop hook and the center portion of the body are in different planes.

3. The system of claim 1 further comprising:

at least one cutout in the center portion of the body.

4. The system of claim 3 wherein the at least one cutout in the center portion of the body comprises at least one of:

a geometric shape;

a letter;

a word;

a logo; and a design.

5. The system of claim 3 wherein the at least one cutout in the center portion of the body comprises a broadhead wrench.

6. The system of claim 1 wherein the at least one mounting hole set further comprises:

a plurality of mounting hole sets.

7. The system of claim 1 wherein the loop hook further comprises an open hook on the first end of the body.

8. The system of claim 1 further comprising:

a strap; and a loop in the strap configured to engage the loop hook.

9. The system of claim 1 wherein the bow mount further body comprises:

a single piece of metal.

10. The system of claim 1 wherein the at least one mounting hole set further comprises one hole on the first finger and one hole on the second finger.

11. The system of claim 1 wherein the body comprises at least one of:

cold rolled steel;

stainless steel;

titanium;

carbon fiber;

hard plastic; and hard rubber.

12. A bow connector system comprising:

a body comprising:

a first end;

a second end; and a center portion wherein the first end and second end are substantially parallel, and the center portion is at an angle connecting the first end and second end;

a loop hook formed on the first end of the body wherein the loop hook is configured to hook onto a loop;

a bow mount configured on the second end of the body the bow mount further comprising: a first finger, a second finger; and an external attachment point comprising:

a strap;

a loop in the strap configured to engage the loop hook; and a latch.

13. The bow connector system of claim 12 further comprising:

a bend between the first end and center portion such that the loop hook and the center portion of the body are in different planes.

14. The bow connector system of claim 12 wherein the bow mount further comprises:

a first slit on the first finger, a second slit on the second finger, wherein the first slit on the first finger and the second slit on the second finger are, spaced to match a standardized mounting hole pattern on a bow.

15. The bow connector system of claim 12 wherein the body further comprises:

a single piece of metal.

16. A system comprising:

a body comprising:

a first end;

a second end; and a center portion wherein the first end and second end are substantially parallel, and the center portion connects the first end and second end;

a loop hook formed on the first end of the body wherein the loop hook is configured to hook onto a loop; and a bow mount further comprising:

two fingers; and a set of mounting holes, wherein one of each of the holes in the set of mounting hole is on each of the two fingers.

17. The system of claim 16 further comprising:

a bend between the first end and center portion such that the loop hook and the center portion of the body are in different planes.

18. The system of claim 16 wherein the body further comprises:

a single piece of metal.

19. The system of claim 16 further comprising:

at least one cutout in the body, the at least one cutout in the body configured to comprise at least one of:

a geometric shape;

a letter;

a word;

a logo;

a design;

a broadhead wrench; and a bottle opener.

20. The system of claim 16 wherein the loop hook is configured to attach to a loop on a strap.

* * * * *